United States Patent [19]

Sample

[11] Patent Number: 4,807,699

[45] Date of Patent: Feb. 28, 1989

[54] TUBING SLEEVE

[75] Inventor: Clark M. Sample, Bakersfield, Calif.

[73] Assignee: Randy Merkey, Bakersfield, Calif.

[21] Appl. No.: 52,500

[22] Filed: May 21, 1987

[51] Int. Cl.[4] ..... E21B 34/14

[52] U.S. Cl. ..... 166/68; 166/72; 166/105; 166/332; 251/291; 417/434; 417/435

[58] Field of Search ..... 166/332, 316, 242, 112, 166/110, 72, 73, 68, 386, 373; 251/319, 291, 339; 417/434, 435

[56] References Cited

U.S. PATENT DOCUMENTS

| | | | |
|---|---|---|---|
| 2,752,861 | 7/1956 | Hill | 417/434 X |
| 2,924,278 | 2/1960 | Garrett et al. | 166/214 |
| 3,102,495 | 9/1963 | Page | 417/434 |
| 3,115,188 | 12/1963 | Cochran et al. | 166/332 |
| 3,151,681 | 10/1964 | Cochran | 166/332 |
| 3,355,142 | 11/1967 | Kammerer, Jr. et al. | 166/332 |
| 3,552,718 | 1/1971 | Schwegman | 166/332 |
| 3,768,562 | 10/1973 | Baker | 166/332 |
| 4,103,739 | 8/1978 | Hal | 417/434 X |
| 4,645,007 | 2/1987 | Soderberg | 166/386 |

*Primary Examiner*—Stephen J. Novosad
*Assistant Examiner*—Bruce Kisliuk
*Attorney, Agent, or Firm*—Rapkin, Gitlin, Moser & Schwartz

[57] ABSTRACT

A tube shaped sleeve apparatus which includes two cylindrical components adapted to be connected to each other and sections of tubing string by cooperating threads formed at the ends thereof. At spaced intervals in the periphery of the sleeve are a plurality of radial holes or ports and formed in the sleeve bore at opposite ends thereof are stops shoulders. Adapted to be inserted in slidable relation inside the bore of the tubing sleeve is a mandrel which includes a plurality of resilient O-rings or gaskets that are secured in the periphery of the mandrel inside annular grooves formed therein. Formed in the bore of the mandrel and at opposite ends thereof are a second set of stop shoulders. When positioned opposite the holes in the sleeve, the periphery of the mandrel and the gaskets form a tight seal with the wall of the sleeve bore to prevent fluids and gases from the well bore from entering and escaping the tubing sleeve. Through the use of a sleeve operator, which is adapted to be attached to the bottom of a sub-surface rod pump, the mandrel inside the sleeve bore can be directed to shift longitudinally in the bore into a position either opposite or away from the holes to respectively close or open the holes, as desired.

2 Claims, 5 Drawing Sheets

TUBING SLEEVE

FIELD OF THE INVENTION

This invention relates generally to the field of oil and gas production equipment and more particularly to a sleeve apparatus for connection with a tubing string for controlling the entry and escape of well bore fluids and gases to and from the tubing, respectively.

DESCRIPTION OF THE PRIOR ART

In the production of oil and gas from a well, it is the practice generally to drill the well bore, set a casing string down the hole to prevent caving and then run a tubing string down the hole through the bore of the casing string. A sucker rod pump or the like is placed down the bore of the tubing string and positioned in the well where it acts to pump the formation fluids to the surface.

In accordance with the prior art, formation fluids usually enter the tubing string through a series of holes located in the periphery at the top of a closed gas anchor. However, there are several disadvantages associated with the prior art equipment and methods. For example, in order to test for leakage in the system the entire tubing string must be pulled from the hole and tested on the surface. Associated with the prior art technology is also the added risk of a blowout occurring on the surface as a result of a buildup of formation fluids and/or gases in the well.

The sleeve apparatus of the present invention is specifically designed for use in a well bore to control the flow of fluids and gases between the interior and exterior areas of a tubing string. The sleeve apparatus provides a cylindrical device comprised of two components which are adapted to be threadedly connected to each other. These components are also adapted to be fastened at each of their respective ends to a section of the tubing string. Formed in the periphery of the sleeve are a series of holes or ports through which formation fluids and gases may enter or escape. Inside the sleeve is located a generally cylindrical shaped mandrel, which is adapted to slide the distance from one end of the sleeve bore to the other between stop shoulders formed at the opposite ends thereof. Formed in the periphery of the mandrel at spaced intervals are O-rings or gaskets to secure a seal between the O-rings and the wall of the sleeve bore. The mandrel acts to either open or close the ports to allow or prevent the fluids and gases from entering or escaping, as desired. To accomplish this, the mandrel is manipulated longitudinally in either direction inside the sleeve bore by a sleeve operator, which is attached to the bottom end of a sub-surface rod pump. The sleeve operator is manipulated from the surface either from above or below the location of the sleeve. The ports may be opened by engaging the sleeve operator with the bore of the mandrel and, with the use of sufficient force, directing the mandrel downwardly. By reversing the direction of the sleeve operator, the mandrel may be moved upwardly through the sleeve bore to seal off and close the ports.

The device of the present invention thus solves many of the problems associated with the devices of the prior art, including, among other things, the maximization of the potential for safety and cost control.

The advantages and distinctions of the present invention over the prior art will become clearly evident in the following disclosure.

SUMMARY OF THE INVENTION

The present invention in its preferred embodiment comprises a tube shaped sleeve apparatus which includes two cylindrical components. The components are adapted to be connected by cooperating threads formed at the ends thereof. At the other end of each of the components are threads that are used to securely connect the sleeve to a section of the tubing string. At spaced intervals in the periphery of the sleeve are a plurality of radial holes or ports. Formed in the sleeve bore at opposite ends thereof are stops shoulders.

Adapted to be inserted in slidable relation inside the bore of the tubing sleeve is a mandrel which includes a plurality of resilient O-rings or gaskets that are secured firmly on the periphery of the mandrel inside annular grooves that are formed therein. Formed in the bore of the mandrel and at opposite ends thereof are a second set of sop shoulders. When positioned opposite the holes in the sleeve, the mandrel forms a tight seal with the walls of the sleeve bore to prevent fluids and gases from the well bore from entering or escaping the tubing sleeve. Through the use of a sleeve operator, which is adapted to be attached to the bottom of a sub-surface rod pump, the mandrel inside the sleeve bore can be directed to shift longitudinally in the bore into a position either opposite or away from the holes to respectively close or open the holes, as desired. In practice, the sleeve operator is passed from an initial position usually above the sleeve into the mandrel bore where it may be adjusted to drive the mandrel in a downwardly direction to permit the opening of the holes. Once the mandrel is moved downwardly and its bottom edge abuts the stop shoulder formed in the sleeve bore, the rod pump may be passed through the bore and seated to begin the operation of pumping the well bore fluids to the surface. When it becomes necessary to close the holes, the rod pump is brought towards the surface in order to permit the sleeve operator to engage the bottom of the lower stop shoulder formed in the mandrel bore. By pulling on the rods attached to the pump, the mandrel is driven upwardly to a position opposite the holes wherein a tight seal is formed between the O-rings and the interior wall of the sleeve bore to isolate the interior of the tubing string for precluding the entry and exit of well fluids and gases through the holes.

An object of the present invention is to provide a tubing sleeve that precludes formation fluids or gases from entering the tubing string while the pump is being withdrawn from the well for repair or replacement.

Another object of the present invention is to provide a tubing sleeve that allows the pump to be pulled off seat to flush the tubing.

Another object of the present invention is to provide a tubing sleeve that can isolate the interior of the tubing string from fluids and/or gases entering from the well bore to enable the tubing string to be tested for leakage without having to pull the entire string assemblage from the well.

Another object of the present invention is to provide a tubing sleeve that can be manipulated to isolate the bore of the tubing string to prevent surface blow outs due to the accumulation of well bore fluids and/or gases.

Still another object of the present invention is to provide a tubing sleeve that may be opened or closed by surface manipulation of a sleeve operator.

Yet still another object of the present invention is to provide a tubing sleeve that maximizes the potential for production related cost controls.

Yet still another object of the present invention is to provide a tubing sleeve that maximizes the potential for safety in and around the area of the well head.

Still another object of the present invention is to provide a tubing sleeve that is convenient and easy to use and inexpensive to manufacture.

Other object and advantages of the present invention will become apparent in the following specifications when considered in light of the attached drawings wherein a preferred embodiment of the invention is illustrated.

A BRIEF DESCRIPTION OF THE DRAWINGS

DETAILED DESCRIPTION OF THE PREFERRED EMBODIMENT

Figure 1:
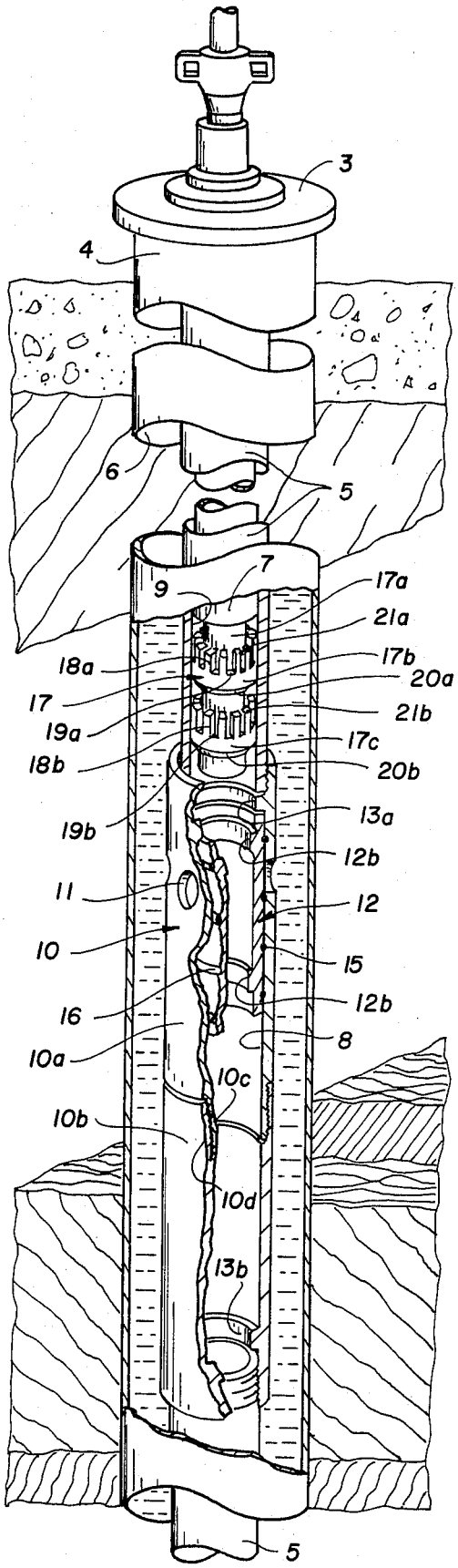
FIG. 1 is partially cut away elevational view of the tubing sleeve in accordance with the present invention illustrating the sleeve operator positioned over the sleeve housing which contains the mandrel.
Figure 2:
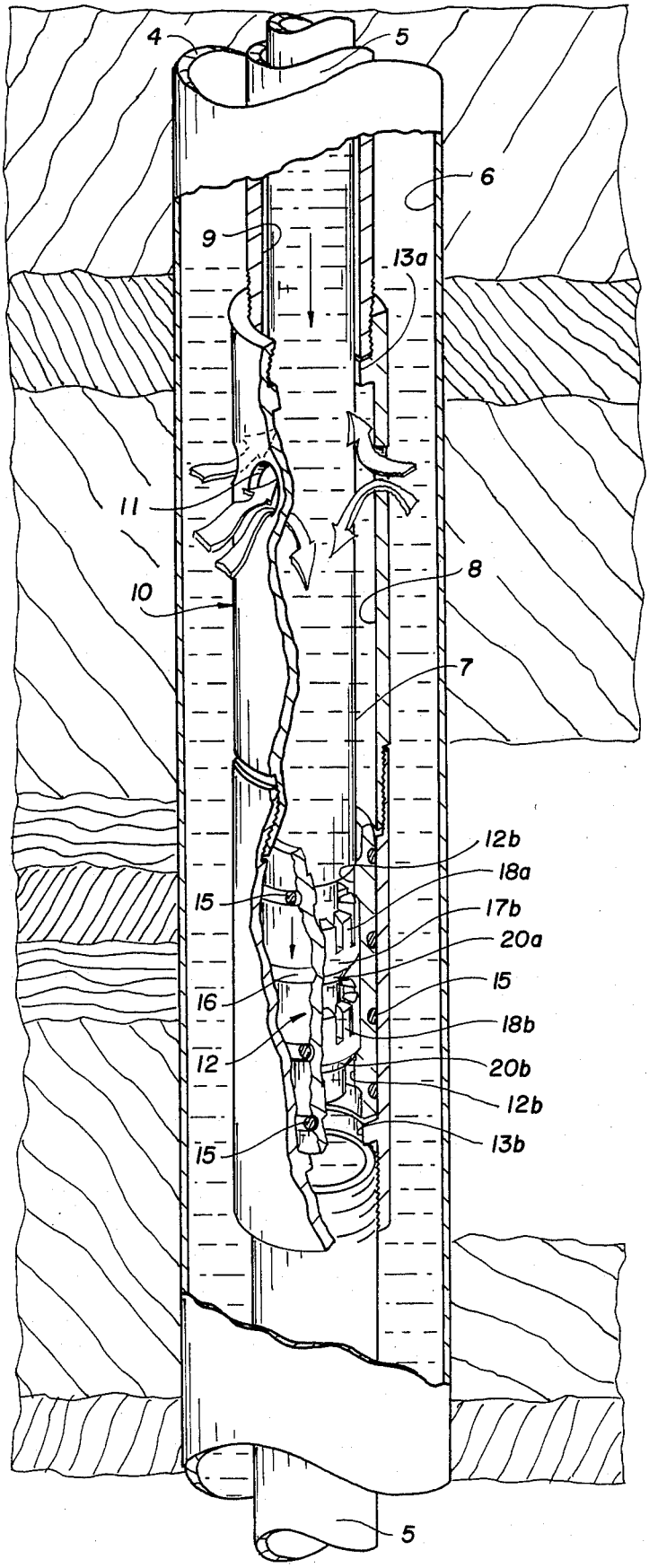
FIG. 2 is a partially cut away elevational view of the present invention illustrating the sleeve operator engaging the bore of the mandrel, and the radial ports in the open position.

Referring more particularly to the drawings, FIG. 1 indicates several of the main components of a pumping unit. Depicted in FIG. 1 is a casing head 3 and a casing string 4, which is installed in an open hole for the purpose, among other things, of preventing cavings. Tubing string 5 is disposed down the well through the bore 6 of casing string 4. Sub-surface pump 7 is disposed down through the bore 9 of tubing string 5 and seated at the desired depth. At a location usually below pump 7 is tubing sleeve 10 comprised typically of an upper cylindrical member 10*a* and a lower cylindrical member 10*b*. Member 10*a* threadedly engages member 10*b* by means of the illustrated threads 10*c* and 10*d*, respectively. A plurality of spaced radial ports designated by the numeral 11 are formed in the periphery of tubing sleeve 10. The upper end of member 10*a* and the lower end of member 10*b* are adapted to be threadedly connected to respective sections of tubing string 5. A stop shoulder 13*a* is formed circumferentially of the inside of the upper section of tubing sleeve 10 and a companion stop shoulder 13*b* is formed circumferentially of the inside of the lower section of tubing sleeve 10.

Disposed in the bore 8 in slidable relation therewith is an inner tubular member or mandrel 12. Formed in the periphery of mandrel 12 are a plurality of conventionally designed seal ring gaskets 15 in the form of resilient rubber or rubber like O-rings disposed in annular grooves 16 which are adapted to receive the O-rings 15. O-rings 15 engage the wall of bore 8 to create a seal therebetween and fix mandrel 12 in its upward most position, wherein radial ports 11 are fully closed, and in its lower most position, wherein radial ports 11 are fully opened, when mandrel 12 is moved longitudinally inside bore 8 from one position to another.

Mandrel 12 includes a stop shoulder 12*a* formed circumferentially of the inside of the upper section thereof and a companion stop shoulder 12*b* formed circumferentially of the inside of the lower section thereof.

Threadedly connected to the bottom end of pump 7 is a sleeve activator 17 comprising a central shaft member 17*a* and tubular members 17*b* and 17*c* each formed circumferentially of the shaft member 17*a* in spaced apart relation. Tubular members 17*b* and 17*c* each have a plurality of upwardly directed depending legs which are formed integral therewith and designated by the numerals 18*a* and 18*b*, respectively. Depending legs 18*a* and 18*b* are capable of expansion and contraction around the shaft member 17*a* and may be formed by providing circumferentially spaced slots 19*a* and 19*b* through the upper section of tubular members 17*b* and 17*c*, respectively, extending from the uppermost point of said depending legs to respective base portions 20*a* and 20*b*. Depending legs 18*a*. and 18*b* terminate in inwardly directed respective foot portions 21*a* and 21*b* having upper cam surfaces inclined in an upward and inward direction for engagement with the lower edges of shoulders 12*a* or 12*b*.

Figure 4:
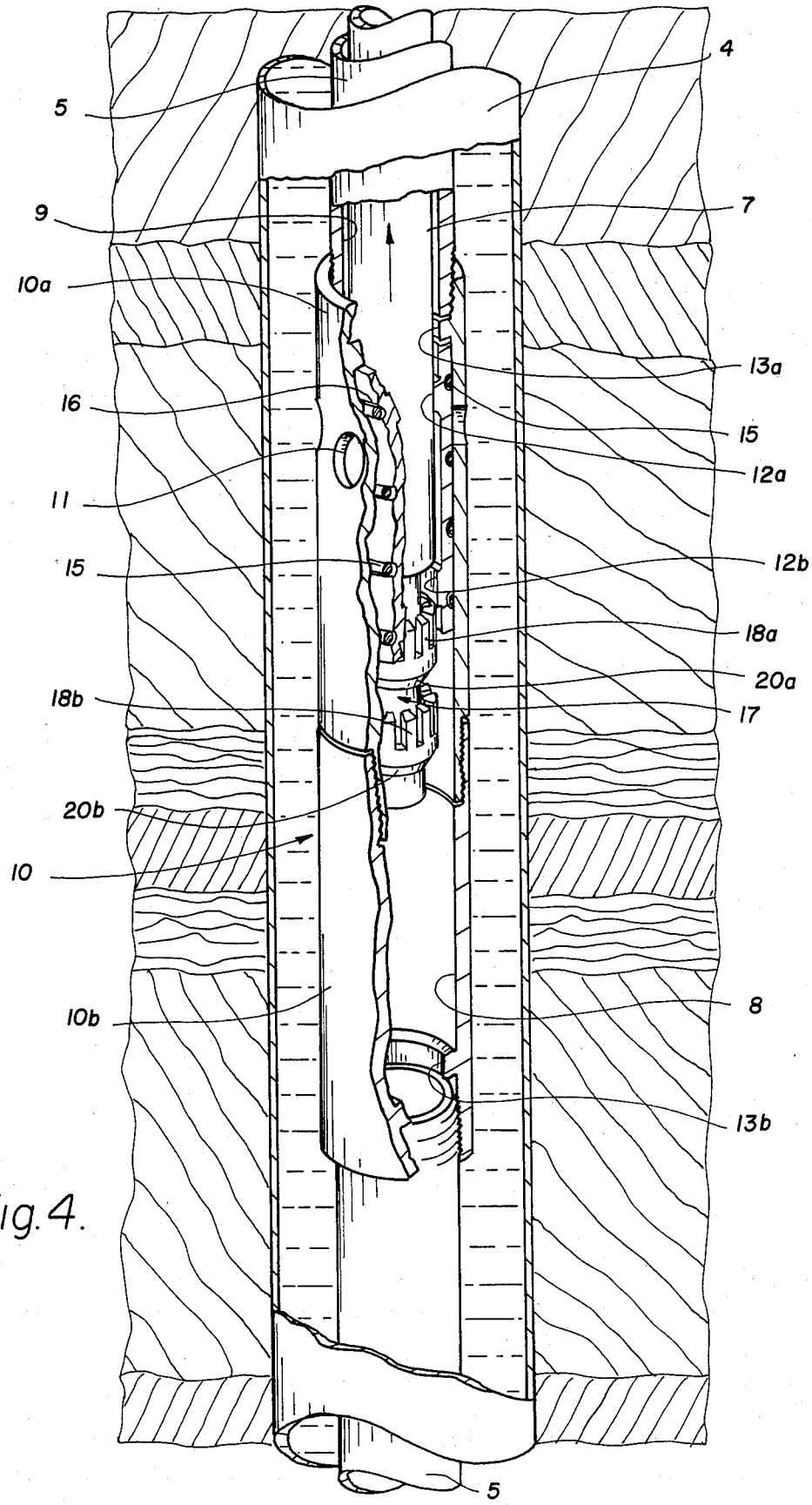
FIG. 4 is a partially cut away elevational view of the device of the present invention illustrating the sleeve operator in engagement with the stop shoulder in the bottom section of the mandrel, and the radial ports in the closed position.
Figure 5:
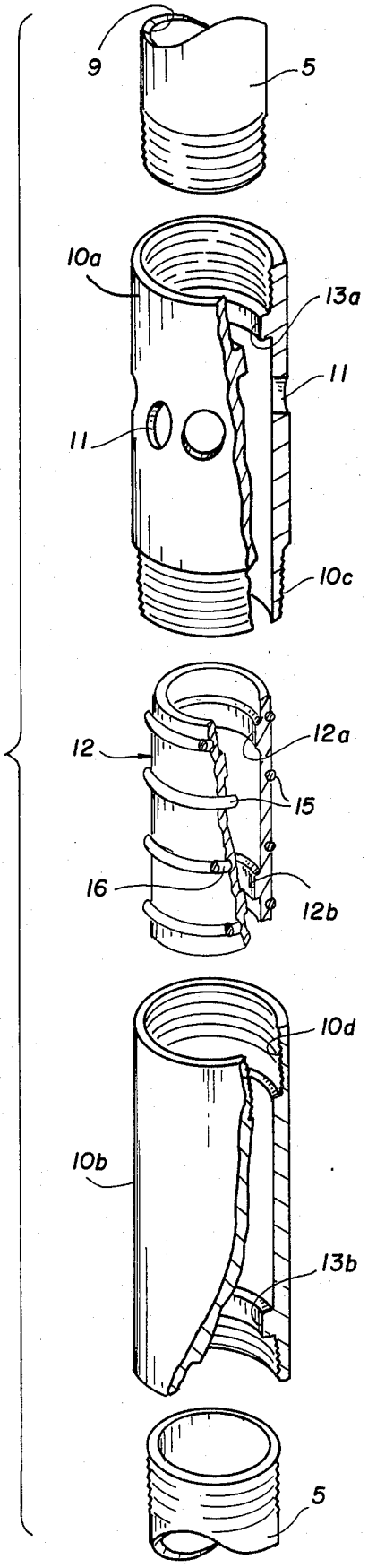
FIG. 5 is an exploded view of the tubing sleeve assemblage in accordance with the present invention.

The device of the present invention may be operated in the following manner: after the casing string 4 is installed down the well bore, the tubing string 5 is assembled above-ground by connecting two or more sections of tubing string 5 and then running the connected sections down the hole in the desired sequence. To assemble tubing sleeve 10, it is the usual procedure to insert mandrel 12 into either member 10*a* or 10*b* and then connect members 10*a* and 10*b* using the cooperating threads formed at the ends thereof. The free ends of tubing sleeve 10 are then threadedly connected to respective end sections of tubing string 5. The assemblage is then lowered into the bore 6. Under the usual circumstances, mandrel 12 is positioned initially so that the radial ports 11 are in the closed position preventing well fluids or gases from entering or escaping bore 8 of tubing string 5. In the closed position, mandrel 12 is releasably retained in the upper section of bore 8. Radial ports 11 are thus closed by the engagement of the periphery of the mandrel 12 and O-rings 15 with the wall of bore 8, as shown in FIGS. 1 and 4, and the co-engagement of the shoulders 12*a* and 13*a*. In this position, the periphery of mandrel 12 and O-rings 15 engage the wall of bore 8 creating an impervious seal to secure the isolation of radial ports 11 and prevent the entry or escape of well fluids and gases therethrough.

In order to open radial ports 11, the operator at the surface lowers sleeve operator 17 towards bore 8 until it comes into engagement with the uppermost portion thereof. With a sufficient amount of downward pressure, depending legs 18*b* and then 18*a* are compressed to permit the sleeve operator 17 to enter bore 8. Once inside bore 8, depending legs 18*a* and 18*b* expand to firmly engage the wall of bore 8. Additional downward pressure causes base 20*b* to engage shoulder 12*b* forcing mandrel 12 to shift downwardly through bore 8 until the lowermost edge of mandrel 12 engages the upper edge of shoulder 13*b*. The engagement of O-rings 15 with the wall bore 8 helps to retain mandrel 12 in a stationary position. Radial ports 11 are now open and will permit the entry and escape of well fluids and gases therethrough.

Figure 3:
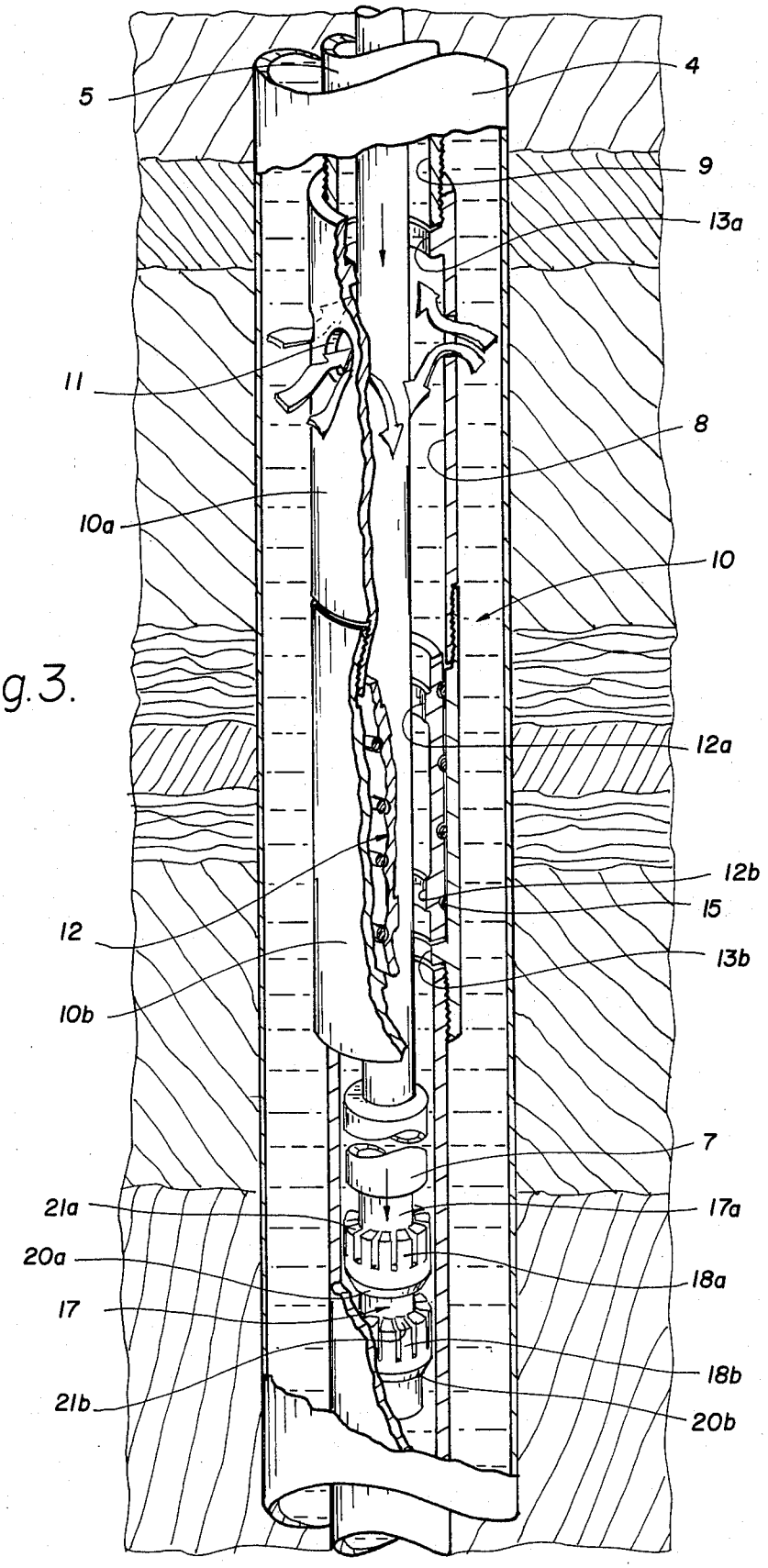
FIG. 3 is a partially cut away elevational view of the device of the present invention illustrating the sleeve operator in a position below the tubing sleeve and the radial ports in the open position.

If it is desired to lower pump 7 below the location of tubing sleeve 10 and seat it into position to enable it to pump fluids to the surface, as shown in FIG. 3, then a sufficient downward force must be imposed through the rods above (not shown) to unseat the sleeve operator 17 from inside the bore 8. Specifically, a sufficient downward force must be imparted to enable the compression of depending legs 18*a* and 18*b* and permit the sleeve operator 17 to pass out through the bottom of bore 8.

If it is desired to close radial ports 11 to prevent the entry and escape of well fluids and gases therethrough, then mandrel 12 must be unseated and shifted upwardly through the bore 8 until the upper edge of mandrel 12 engages the bottom edge of shoulder 13*a*. To accomplish this, the pump 7 must be unseated and the connecting rods pulled upwardly until foot portion 21*a* engages the lower edge of shoulder 13*b*. A sufficient upward force will then overcome the resistance of the seal created by the engagement of O-rings 15 with the wall of bore 8 and permit mandrel 12 to move in an upwardly direction until mandrel 12 can move no further, as heretofore described, and O-rings 15 are again in sealing engagement with the wall of bore 8. A still further sufficient upward force on the connecting rods will cause the depending legs 18*a* and 18*b* to again compress (in reverse order) and permit sleeve operator 17 to pass through and out the top of bore 8.

In another embodiment of the present invention, expansion rings (not shown) are incorporated into the periphery of mandrel 12 at the top and bottom thereof and received by cooperating annular grooves (not shown) to form a tight seal with the walls of bore 8 to prevent the entry and escape of well fluids and gases through radial ports 11. In this alternative embodiment, the mandrel may be modified so that the center section is tapered and smaller in diameter relative to the diameter of the end portions.

In yet another embodiment of the present invention, small metal plungers (not shown) mounted in a housing in ball and socket fashion are threadedly inserted at spaced intervals in the periphery of tubing sleeve 10 and received in annular grooves (not shown) formed in the periphery of mandrel 12 to ensure a stationary operating position of the mandrel when the same is either in the open or closed position, as heretofore described.

While the invention will be described in connection with a certain preferred embodiment it is to be understood that it is not intended to limit the invention to that particular embodiment. Rather, it is intended to cover all alternatives, modifications and equivalents as may be included within the spirit and scope of the invention as defined by the appended claims.

I claim:

1. A system suitable for use in conjunction with a tubing string in a well with an operational rod pump and a closed gas anchor, which comprises:

a. an outer tubular member located below said pump comprising first and second cylindrical members, including a first means incorporated at one end of said first cylindrical member and a second means incorporated at one end of said second cylindrical member, said first and second means adapted to connect said first cylindrical member to said second cylindrical member, a third means incorporated at a second end of said first cylindrical member adapted to engage a cooperating fourth means incorporated at one end of a first tubing string member to connect said first cylindrical member to said first tubing string member, a fifth means incorporated at the second end of said second cylindrical member adapted to engage a cooperating sixth means incorporated at one end of a second tubing string member to connect said second cylindrical member to said second tubing string member, said outer tubular member including a plurality of spaced apart radial ports formed in the periphery of said outer tubular member through which fluids and gases are allowed to enter and exit and upper and lower circular shoulders formed in the bore of said outer tubular member at opposite ends thereof;

b. an inner tubular member insertable into the bore of said outer tubular member in slidable relation therewith for opening and closing said radial ports, said inner tubular member having a slightly smaller external diameter than the diameter of said bore through which it moves axially between said upper and lower shoulders and including one or more gasket means in the periphery of said inner tubular member; and, c. an activator means that works independently of the oscillating rods while they are oscillating in an operating rod pump and engages said inner tubular member to move said inner tubular member axially within said outer tubular member, said activator means being adapted for attachment to the bottom of an inactive rod pump and including at least one cylindrical member having a plurality of integrally formed compressible elongated leg members depending therefrom whereby, when said depending leg members releasably engage said inner tubular member to move said inner tubular member longitudinally of said bore in a first direction between said upper and lower shoulders, said radial ports open to allow fluids and gases to flow between the interior and exterior of said outer tubular member and, when said inner tubular member is moved longitudinally of said bore in a second direction between said upper and lower shoulders, said radial ports are closed to prevent fluids and gases from flowing between the interior and exterior of said outer tubular member.

2. A system suitable for use in conjunction with a tubing string in a well with an operational rod pump and a closed gas anchor, which comprises:

a. an outer tubular member located below said rod pump having threaded connections at each end thereof for attachment to a first and second section of a tubing string, said outer tubular member including a plurality of spaced apart radial ports formed in the periphery of said outer tubular member through which fluids and gases are allowed to enter and exit and upper and lower circular shoulders formed in the bore of said outer tubular member at opposite ends thereof;

b. an inner tubular member insertable into the bore of said outer tubular member in slidable relation therewith for opening and closing said radial ports, said inner tubular member having a slightly smaller external diameter than the diameter of said bore through which it moves axially between said upper and lower shoulders and including one or more gasket means in the periphery of said inner tubular member; and, c. an activator, means that works independently of the oscillating rods while they are oscillating in an operating rod pump and engages said inner tubular member to move said inner tubular member axially within said outer tubular member, said activator means being adapted for attachment to the bottom of said rod pump and including at least one cylindrical member having a plurality of integrally formed compressible elongated leg members depending therefrom whereby, when said depending leg members releasably engage said inner tubular member to move said inner tubular member longitudinally of said bore in a first direction between said upper and lower shoulders, said radial ports are open to allow fluids and gases to flow between the interior and exterior of said outer tubular member and, when said inner tubular member is moved longitudinally of said bore in a second direction between said upper and lower shoulders, said radial ports are closed to prevent fluids and gases from flowing between the interior and exterior of said outer tubular member.

* * * * *